US012150524B2

(12) United States Patent
Chen

(10) Patent No.: US 12,150,524 B2
(45) Date of Patent: Nov. 26, 2024

(54) BREATHABLE SOLE AND AN AIR-DISCHARGING METHOD OF SHOE

(71) Applicant: JINGDONG TECHNOLOGY (PUTIAN) CO., LTD, Fujian (CN)

(72) Inventor: Zhendeng Chen, Fujian (CN)

( * ) Notice: Subject to any disclaimer, the term of this patent is extended or adjusted under 35 U.S.C. 154(b) by 12 days.

(21) Appl. No.: 18/119,285

(22) Filed: Mar. 9, 2023

(65) Prior Publication Data

US 2023/0218034 A1 Jul. 13, 2023

Related U.S. Application Data

(63) Continuation-in-part of application No. PCT/CN2022/075422, filed on Feb. 7, 2022.

(30) Foreign Application Priority Data

Feb. 7, 2021 (CN) ..... 202110178833.7
Jun. 22, 2022 (CN) ..... 202221566905.1

(51) Int. Cl.
*A43B 7/08* (2022.01)
*A43B 13/12* (2006.01)

(52) U.S. Cl.
CPC ..... *A43B 7/087* (2013.01); *A43B 7/081* (2013.01); *A43B 13/122* (2013.01); *A43B 13/125* (2013.01)

(58) Field of Classification Search
CPC ..... A43B 7/08; A43B 7/088; A43B 7/087; A43B 7/082; A43B 7/081; A43B 7/083; A43B 13/206; A43B 13/20; A43B 13/203; A43B 13/125
USPC ..... 36/3 B
See application file for complete search history.

(56) References Cited

U.S. PATENT DOCUMENTS 5,295,313 A * 3/1994 Lee ..... A43B 7/082 36/3 R
5,477,626 A * 12/1995 Kwon ..... A43B 7/082 36/3 R
5,515,622 A * 5/1996 Lee ..... A43B 7/082 36/3 R
2018/0242070 A1* 8/2018 Slater ..... F04F 7/00

* cited by examiner

*Primary Examiner* — Nathan E Durham
*Assistant Examiner* — Abby M Spatz

(57) ABSTRACT

A breathable sole, including a midsole and an outsole; a bottom surface of the midsole has an air chamber, an air inlet channel and a single-way air outlet channel; the air chamber is provided at a heel position; the air inlet channel comprises a dispersed air-collecting channel and an air-guiding channel; the dispersed air-collecting channel is provided at the sole and is provided with air inlet holes; the air-guiding channel is connected with a rear position of the dispersed air-collecting channel and the air chamber; the single-way air outlet channel is a Tesla Valve which has an end connecting to a front position of the air chamber, and has another end provided with an air outlet hole penetrating the upper surface of midsole; the single-way air outlet channel imposes a higher resistance against air flowing from the air outlet hole to the air chamber.

2 Claims, 11 Drawing Sheets

BREATHABLE SOLE AND AN AIR-DISCHARGING METHOD OF SHOE

FIELD OF THE INVENTION

The invention relates to the technical field of breathable shoes, in particular to a breathable sole and an air-discharging method of shoe.

BACKGROUND OF THE INVENTION

Shoes are common in daily life. Traditional sports shoes generally increases the air permeability of the shoes by changing the material of the uppers; however, since sweating of feet mainly occurs at the soles, changing the material of the uppers are not effective enough to increase the air permeability of the shoes.

To solve this problem, a Chinese patent (no.: CN100423663C) discloses a kind of polyurethane-injected shoe with air permeability and moisture expulsion function, comprising an upper, an insole, a midsole and a polyurethane outsole; the upper and the outsole are integrally formed by injection molding, characterized in that a heel of the polyurethane outsole comprises an airbag storing chamber in which an airbag is disposed; a front part of the insole is provided with air-permeable through holes; the midsole is provided between the insole and the outsole; the midsole comprises air channels and a single-way air inlet valve; a heel part of the midsole is provided with a pressing hole allowing the airbag to protrude; a shoe interior space is in communication with the airbag via the air-permeable through holes, the air channels of the midsole and the single-way air inlet valve; a heel of the outsole comprises an air outlet hole allowing the external environment to be in communication with the air bag, and the air outlet hole comprises a single-way air outlet valve.

The direction of the air flow of the prior art relies on the single-way valves which are opened and closed by movable parts provided internally. Each step will lead to one time of air expulsion; therefore the opening and closing of the single-way valves are frequent. When playing sports such as running, the single-way valves will experience frequent operation and heavier load, which lead to aging and malfunctioning of the movable parts. When the sole is in touch with the ground, a certain amount of dust and moisture will unavoidably enter the single-way valves. Since the interiors of the single-way valves are very narrow, even a little amount of dust entering will block the movable parts and lead to malfunctioning of the single-way valves. The unreliability issue affects the promotion of breathable shoes.

BRIEF SUMMARY OF THE INVENTION

To solve the aforementioned problems, this invention provides a breathable sole and an air-discharging method of shoe.

This invention adopts the following technical solution:

A breathable sole, comprising a midsole and an outsole; a bottom surface of the midsole comprises an air chamber which subsides inwards, an air inlet channel, and a single-way air outlet channel; the air chamber is provided at a heel position of the midsole, and is a dome structure subsiding from an outer edge of the air chamber to a center of the air chamber; the air inlet channel comprises a dispersed air-collecting channel and an air-guiding channel; the dispersed air-collecting channel is disposed at a forefoot position of the midsole; air inlet holes are distributed in the dispersed air-collecting channel and penetrate an upper surface of the midsole; the air-guiding channel connects the dispersed air-collecting channel to a rear position of the air chamber; the single-way air outlet channel is a Tesla valve which has an end connecting to a front position of the air chamber and another end provided with an air outlet hole penetrating the upper surface of the midsole; the single-way air outlet channel imposes a higher resistance against air flowing from the air outlet hole to the air chamber than air flowing from the air chamber to the air outlet hole; an upper surface of the outsole and a bottom surface of the midsole are sealed and adhered together, such that the air inlet channel, the air chamber and the single-way air outlet channel are sealed between the outsole and the midsole.

Further, the midsole is made of highly resilient materials; a circumference of the air chamber is provided with a step edge which subsides from the bottom surface of the midsole; a rear end of the step edge is formed with a rear connecting gap which also subsides inwards; the air-guiding channel is connected to the air chamber via the rear connecting gap; when the midsole is compressed at the heel position, the rear connecting gap is deformed and closed; a front end of the step edge is formed with a front connecting gap which also subsides inwards; the single-way air outlet channel is connected to the air chamber via the front connecting gap; two lateral sides of the front connecting gap each comprises an outer expanding surface which keeps the front connecting gap open when the midsole deforms.

Further, the upper surface of the outsole is provided with an embedding block which protrudes outwards from the upper surface of the outsole; the embedding block corresponds to the air chamber and rests on the step edge; the upper surface of the outsole and the bottom surface of the midsole are sealed and adhered by hot-melting or gluing, and there is a non-adhesive close contact between a top surface of the embedding block and the step edge.

Further, the midsole is integrally formed by expanded thermoplastic polyurethane (ETPU) pellets.

Further, a heel position of the midsole is provided with a first outer expanding portion protruding from one side of the heel position of the midsole; when the midsole is configured to be connected to an upper, the first outer expanding portion is located outside the upper; the single-way air outlet channel comprises a forward section, an arc-shaped transition section, and a return section sequentially arranged; the single-way air outlet channel extends forward from the front connecting gap to the forefoot position of the midsole via the forward section, turns back towards the heel position of the midsole via the arc-shaped transition section, and then extends back to the first outer expanding portion at the heel position is the midsole via the return section, such that the air outlet hole is formed in the first outer expanding portion.

Further, the outsole is provided with a second outer expanding portion corresponding to the first outer expanding portion of the midsole.

Further, the dispersed air-collecting channel comprises annular channels which radiate concentrically and form a labyrinth pattern; the air-guiding channel is connected with the annular channels.

Further, the breathable sole also comprises an insole, provided on the upper surface of the midsole; a forefoot position of the insole is provided with a through hole which penetrates an upper surface and a lower surface of the insole and corresponds to the air inlet holes of the dispersed air-collecting channel; an air-permeable mesh layer is provided within the through hole.

An air-discharging method to discharge air from a shoe by using the breathable sole according to any one of the aspects of the breathable sole as described above; the method comprises the following steps:

Step 1: when a heel portion of the breathable sole is first being compressed during walking; the midsole is compressed and deformed at a rear position of the heel position of the midsole such that the rear connecting gap is closed;

Step 2: when pressure is continuously imposed to the heel position of the midsole during walking, the air chamber of the midsole is compressed and deformed, and an internal space of the air chamber shrinks; as the rear connecting gap is closed, air in the air chamber is discharged from the front connecting gap to the single-way air outlet channel; the air passes through the single-way air outlet channel and is then discharged to an external environment through the air outlet hole; two lateral sides of the front connecting gap each comprises an outer expanding surface such that the front connecting gap is not closed when the midsole deforms;

Step 3: when walking continues, the heel portion of the breathable sole is no longer being compressed, and the midsole is elastically restored at the rear position of the heel position of the midsole, so that the rear connecting gap is opened, and the internal space of the air chamber 11 expands to generate negative pressure; since the single-way air outlet channel imposes a higher resistance against the air flowing from the air outlet hole to the air chamber than the air flowing from the air chamber to the air outlet hole, it is difficult for the air to reversely enter the air chamber from the front connecting gap; the negative pressure is transmitted to the dispersed air-collecting channel through the air-guiding channel, and air in the shoe is drawn into the dispersed air-collecting channel through the air inlet holes, and then enters the air chamber 11 through the air-guiding channel;

Steps 1-3 are then repeated so long as walking continues, such that the air in the shoe keeps entering into the breathable sole and then being discharged to the external environment.

Comparing with the prior art, the breathable sole and the air-discharging method of shoe adopt a single-way air outlet channel in the form of a Tesla Valve which allows the air to flow in single-way and prevents the air from flowing reversely by causing divided streams of air flowing reversely to offset each other according to the operating principle of a Tesla valve; there are no movable parts such that the life span is longer and the product is more reliable; each of the midsole and the outsole can be integrally formed by plastic foams and then the two are adhered together, this production method is easy with a high efficiency and a low production cost; the air inlet channel is connected to the rear end of the air chamber to fit with the walking gesture of the user; the rear connecting gap closes when the heel of the user touches the ground during walking, and opens when the heel is lifted; the single-way air outlet channel has three sections appropriately arranged in the midsole; the front connecting gap is provided with outer expanding surfaces which keep the front connecting gap open; when walking, the moisture and odour in the shoe are discharged to the external environment to prevent foot odour.

A breathable sole, comprising a sole body, which is provided with an air chamber, an air outlet channel, and a single-way air inlet channel; the air chamber is arranged at a heel position of the sole body; the single-way air inlet channel has a Tesla valve structure; one end of the single-way air inlet channel is connected with the air chamber, and another end is formed with air inlet holes configured to be connected to an interior of a shoe; the single-way air inlet channel imposes a higher resistance against air flowing from the air chamber to the air inlet holes than air flowing from the air inlet holes to the air chamber; a first end of the air outlet channel is connected with the air chamber, and a second end of the air outlet channel is in communication with an air outlet hole connecting with an external environment. When stepping downwards during walking, the air chamber is compressed, and the air in the air chamber is discharged to the external environment through the air outlet passage. Since the single-way air inlet channel imposes a higher resistance against the air flowing from the air chamber to the air inlet holes, only a small portion of air will flow through the single-way air inlet channel from the air chamber to the air inlet holes when the air chamber is compressed; when lifting the foot as walking continues, the air chamber is elastically restored; the air inside the shoe is drawn into the air chamber through the single-way air inlet channel and is discharged to the external environment when the foot steps downwards again during walking, so as to expel the moisture and odour inside the shoe to avoid the problem of foot odour.

The sole body comprises a midsole and an outsole; a bottom surface of the midsole subsides inwards to form the air chamber, the air outlet channel, and the single-way air inlet channel; an upper surface of the outsole and the bottom surface of the midsole are sealed and adhered such that the air outlet channel, the air chamber, and the single-way inlet channel are sealed between the outsole and the midsole.

The single-way air inlet channel comprises a dispersed air-collecting channel and a Tesla channel; the dispersed air-collecting channel is arranged at a forefoot position of the sole body, and is provided with the air inlet holes penetrating an upper surface of the midsole; the Tesla channel connects the dispersed air-collecting channel to the air chamber, and the Tesla channel is a Tesla Valve.

A cross-sectional area of the air outlet channel gradually reduces from the air chamber towards the air outlet hole, so that air from the external environment will not easily enter the air chamber through the air outlet channel, and the air in the air chamber is more easily discharged through the air outlet channel.

The air outlet channel is connected to a front end of the air chamber, and the single-way air inlet channel is connected to a rear end of the air chamber; when the user walks, the heel of the user first touches the ground, and thus the air chamber is compressed; the connected portion of the single-way air inlet channel and the air chamber will be compressed and sealed, so that the air in the air chamber is unable to pass through the single-way air inlet channel.

The air outlet channel extends towards an outer side wall of the midsole; the second end of the air outlet channel is the air outlet hole formed on the outer side wall of the midsole; a transparent piece is provided on the outer side wall of the midsole corresponding to the air outlet hole; the transparent piece partially covers the air outlet hole such that at least part of the air outlet hole is exposed to the external environment. During use, users may observe the air being discharged from the shoe through the transparent piece. Accordingly, users experience is enhanced and sale in the market can be facilitated.

A groove having a Tesla valve shape is provided on the outer side wall of the midsole extending perpendicularly with respect to the midsole; the groove is said air outlet hole;

the second end of the air outlet channel is connected with an upper end of the groove; the transparent piece, embodied as a transparent film, is provided on the outer side wall of the midsole to partially cover the groove; a lower end of the groove is not covered by the transparent piece and is exposed to the external environment.

A heel position of the midsole is provided with a first outer expanding portion protruding from one side of the heel position of the midsole; a side wall of the outsole is protruded to form a second outer expanding portion corresponding to the first outer expanding portion of the midsole; a middle part of an outer side wall of the first outer expanding portion is recessed to form a groove having a Tesla valve shape; said groove is the air outlet hole; an inner communication channel is provided inside the midsole to connect the groove with the second end of the air outlet channel so that the groove is in communication with the air outlet channel; the outer side wall of the first outer expanding portion is also provided with a transparent member corresponding to the air outlet hole to partially cover the air outlet hole; one end of the groove is not covered by the transparent member. During use, the first outer expanding portion facilitates making of the air outlet hole. Further, the use of air outlet hole having a Tesla valve shape can effectively prevent air from refluxing back into the midsole through the air outlet hole.

The air outlet channel extends to an outer side wall of the midsole so that the second end of the air outlet channel is located on the outer side wall of the midsole; the outer side wall of the midsole is also recessed to form an extended channel; one end of the extended channel is connected to the second end of the air outlet channel; another end of the extended channel is located on the outer side wall of the midsole corresponding to the forefoot position of the midsole; a transparent strip is provided on the outer side wall of the midsole corresponding to the extended channel to cover the extended channel; a hole is provided on the outer side wall of the midsole in front of said another end of the extended channel; the hole is in communication with the extended channel and is not covered by the transparent strip; the hole is the air outlet hole. The extended channel extends the air outlet channel so that users can observe more directly the air discharged from the shoe.

The extended channel has a Tesla valve shape. The extended channel in such Tesla valve shape can effectively prevent air from refluxing back into the midsole through the air outlet hole.

DETAILED DESCRIPTION OF THE INVENTION

Figure 1:
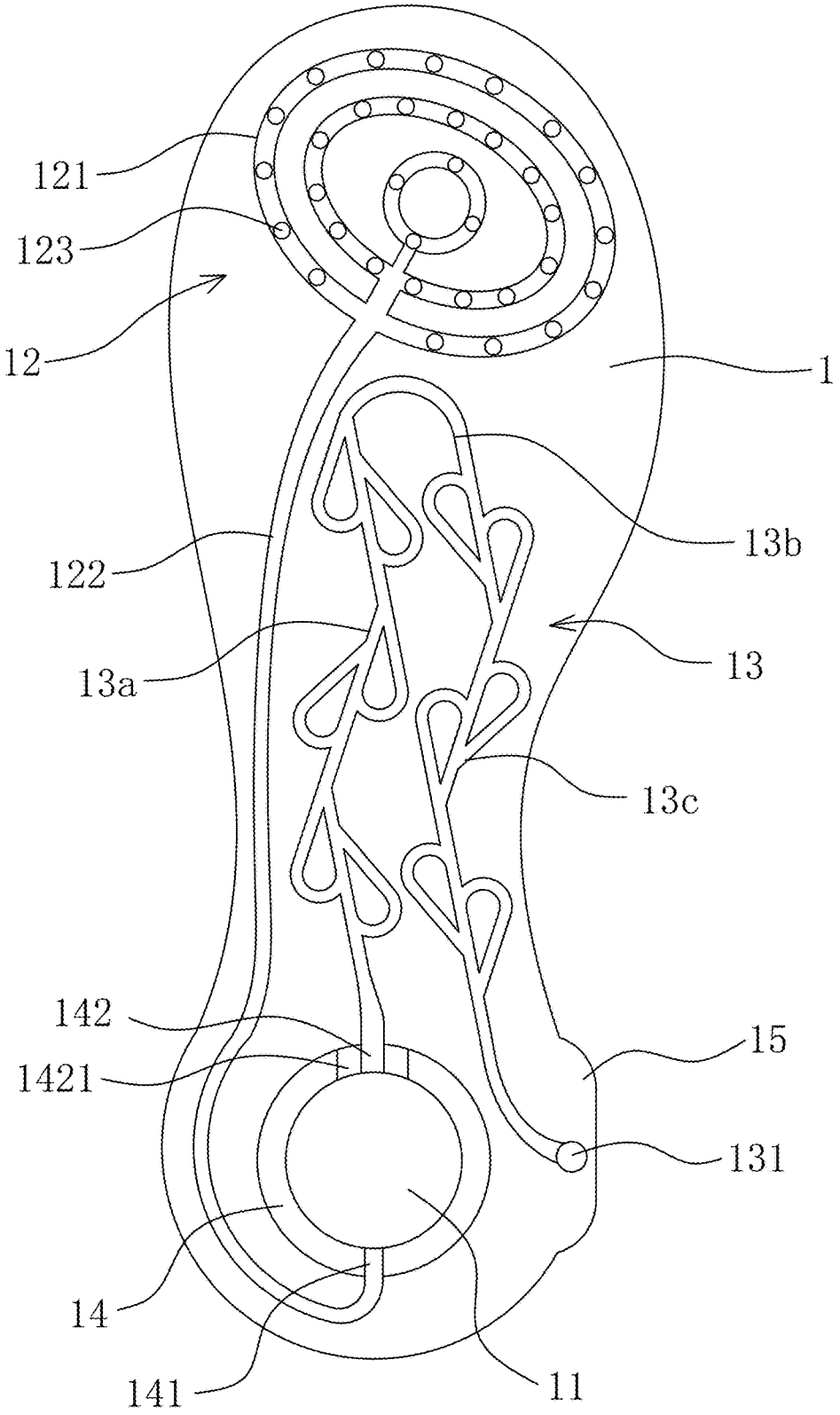
FIG. 1 is a top view of the midsole of this invention.
Figure 2:
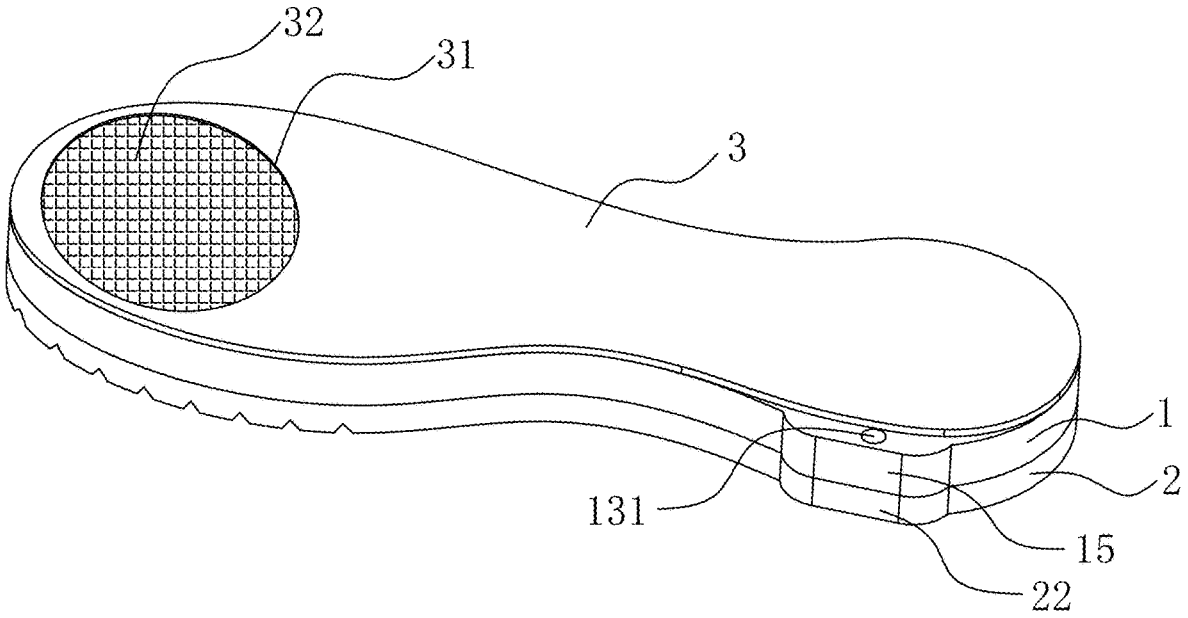
FIG. 2 is a structural view of the breathable sole of this invention.
Figure 3:
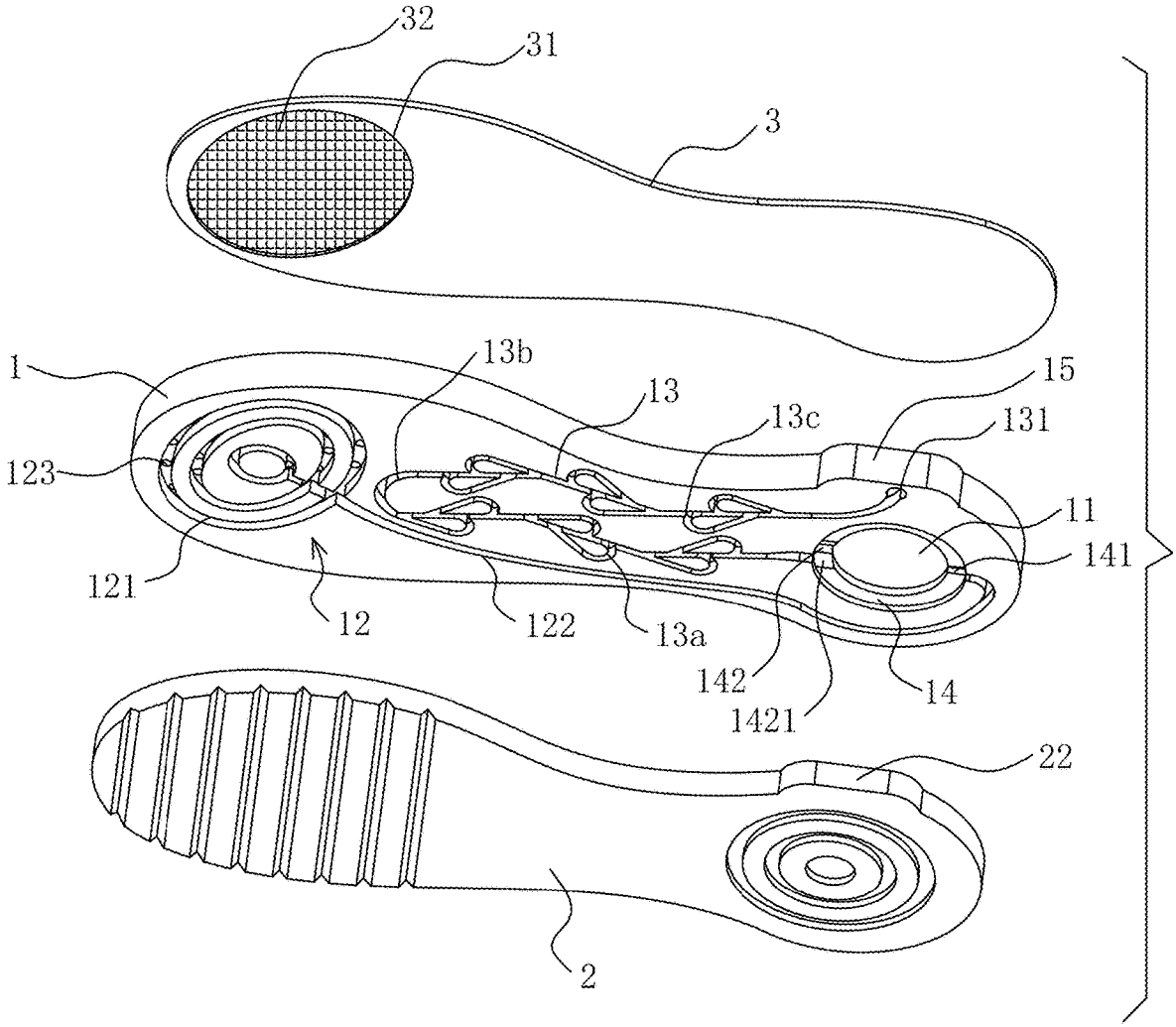
FIG. 3 is a first exploded view of the breathable sole of this invention.
Figure 4:
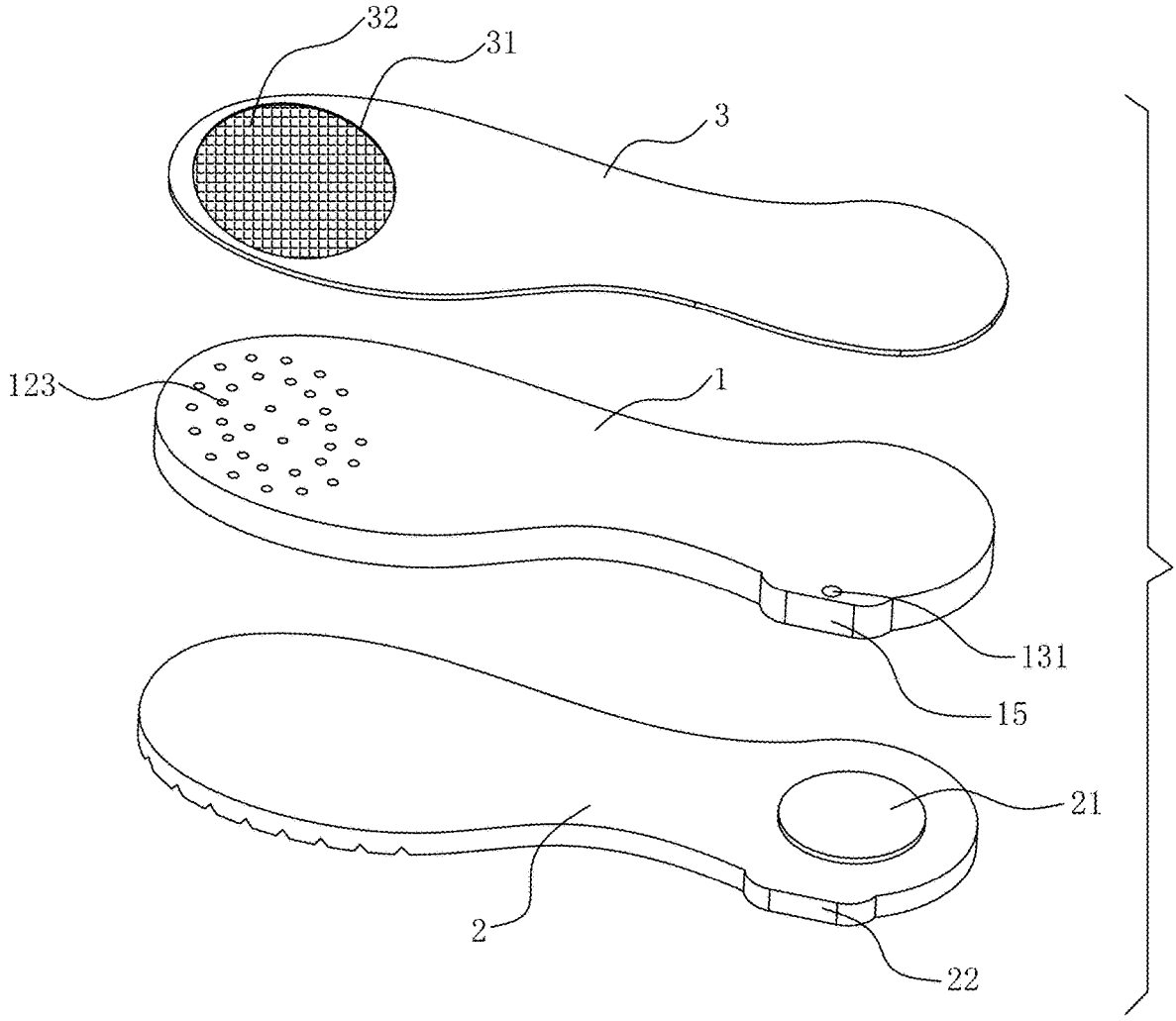
FIG. 4 is a second exploded view of the breathable sole of this invention.

This invention is further illustrated by specific embodiments as follows:

In embodiment 1, as shown in FIG. 1 to FIG. 4, a breathable sole, comprising a midsole 1, an outsole 2 and an insole 3.

The midsole 1 is made of highly resilient materials, for example, integrally formed by expanded thermoplastic polyurethane (ETPU) pellets; a bottom surface of the midsole 1 comprises an air chamber 11 which subsides inwards, an air inlet channel 12, and a single-way air outlet channel 13; the air chamber 11 is provided at a heel position of the midsole 1, and is a dome structure subsiding from the outer edge to the center; this dome structure allows easier discharge of air, but may also be substituted by other shapes, such as rectangular, oval or irregular shape; a circumference of the air chamber 11 is provided with a step edge 14 which subsides from the bottom surface of the midsole 1; a rear end of the step edge 14 is formed with a rear connecting gap 141 which subsides inwards; when the midsole 1 is pressed at the heel position, the rear connecting gap 141 will be deformed and closed; a front end of the step edge 14 is formed with a front connecting gap 142 which subsides inwards; two lateral sides of the front connecting gap 142 each comprises an outer expanding surface 1421 which keeps the front connecting gap 142 open when the midsole 1 deforms.

The air inlet channel 12 comprises a dispersed air-collecting channel 121 and an air-guiding channel 122; the dispersed air-collecting channel 121 is disposed at a forefoot position of the midsole; the dispersed air-collecting channel 121 comprises annular channels which radiate concentrically and form a labyrinth pattern; air inlet holes 123 are evenly distributed in the dispersed air-collecting channel 121 and penetrate an upper surface of midsole 1; the air-guiding channel 122 is connected with the annular channels so as to connect the dispersed air-collecting channel 121 to a rear position of the air chamber 11; the air-guiding channel 122 is connected to the air chamber 11 via the rear connecting gap 141.

The single-way air outlet channel 13 is a Tesla Valve which has an end connecting to a front position of the air chamber 11 via the front connecting gap 142 so as to be in communication with the air chamber 11, and has another end provided with an air outlet hole 131 penetrating the upper surface of the midsole 1; the single-way air outlet channel 13 imposes a higher resistance against air flowing from the air outlet hole 131 to the air chamber 11 than air flowing from the air chamber 11 to the air outlet hole 131; an upper surface of the outsole 2 and a bottom surface of the midsole 1 are sealed and adhered together, such that the air inlet channel 12, the air chamber 11 and the single-way air outlet channel 13 are sealed within.

The upper surface of the outsole 2 is provided with an embedding block 21 which protrudes outwards, corresponds to the air chamber 11 and rests on the step edge 14; the upper surface of the outsole 2 and the bottom surface of the midsole 1 are sealed and adhered by hot-melting or gluing, and there is a non-adhesive close contact between a top surface of the embedding block 21 and the step edge 14.

The heel position of the midsole 1 is provided with a first outer expanding portion 15 protruding from one side of the heel position; when the midsole 1 is connected to an upper, the first outer expanding portion 15 is located outside the upper; the single-way air outlet channel 13 has a forward section 13*a*, an arc-shaped transition section 13*b*, and a return section 13*c* sequentially arranged; the single-way air outlet channel 13 extends forward from the front connecting gap 142 to the forefoot position of the midsole via the forward section 13*a*, turns back towards the heel position of the midsole via the arc-shaped transition section 13*b*, and extends to the first outer expanding portion 15 via the return section 13*c*, such that the air outlet hole 131 is formed in the first outer expanding portion 15. The outsole 2 is provided with a second outer expanding portion 22 corresponding to the first outer expanding portion 15 of the midsole 1.

The insole 3 is provided on the upper surface of the midsole 1, and a forefoot position of the insole 3 is provided with a through hole 31 which penetrates an upper surface and a lower surface of the insole 3 and corresponds to the air inlet holes 123 of the dispersed air-collecting channel 121; an air-permeable mesh layer 32 is provided within the through hole 31.

Breathable shoe, comprising the aforementioned breathable sole, adopts an air-discharging method which comprises the following steps:

Step 1: when a heel portion of the breathable sole is first being compressed during walking; the midsole 1 is compressed and deformed at a rear position of the heel position of the midsole 1 such that the rear connecting gap 141 is closed;

Step 2: when pressure is continuously imposed to the heel position of the midsole during walking, the air chamber 11 of the midsole 1 is compressed and deformed, and an internal space of the air chamber 11 shrinks; as the rear connecting gap 141 is closed, air in the air chamber 11 is discharged from the front connecting gap 142 to the single-way air outlet channel 13; the air passes through the single-way air outlet channel 13 and is then discharged through the air outlet hole 131; two lateral sides of the front connecting gap 142 each comprises an outer expanding surface 1421 such that the front connecting gap 142 will not close when the midsole 1 deforms;

Step 3: when walking continues, the heel portion of the breathable sole is no longer being compressed, and the midsole 1 is elastically restored at the rear position of the heel position of the midsole 1, the rear connecting gap 141 is opened, and the internal space of the air chamber 11 expands to generate negative pressure; since the single-way air outlet channel 13 imposes a higher resistance against the air flowing from the air outlet hole 131 to the air chamber 11 than the air flowing from the air chamber 11 to the air outlet hole 131, it is difficult for the air to reversely enter the air chamber 11 from the front connecting gap 142; the negative pressure is transmitted to the dispersed air-collecting channel 121 through the air-guiding channel 122, and the dispersed air-collecting channel 121 is positioned corresponding to a forefoot position where sweat and odour are easily found; the air in the shoe is drawn into the dispersed air-collecting channel 121 through the air inlet holes 123, and then enters the air chamber 11 through the air-guiding channel 122;

Steps 1-3 are repeated so long as walking continues, such that the air in the shoe keeps entering into the breathable sole and then being discharged to the environment, which means the moisture and odour are expelled timely and hence prevent foot odour.

Figure 5:
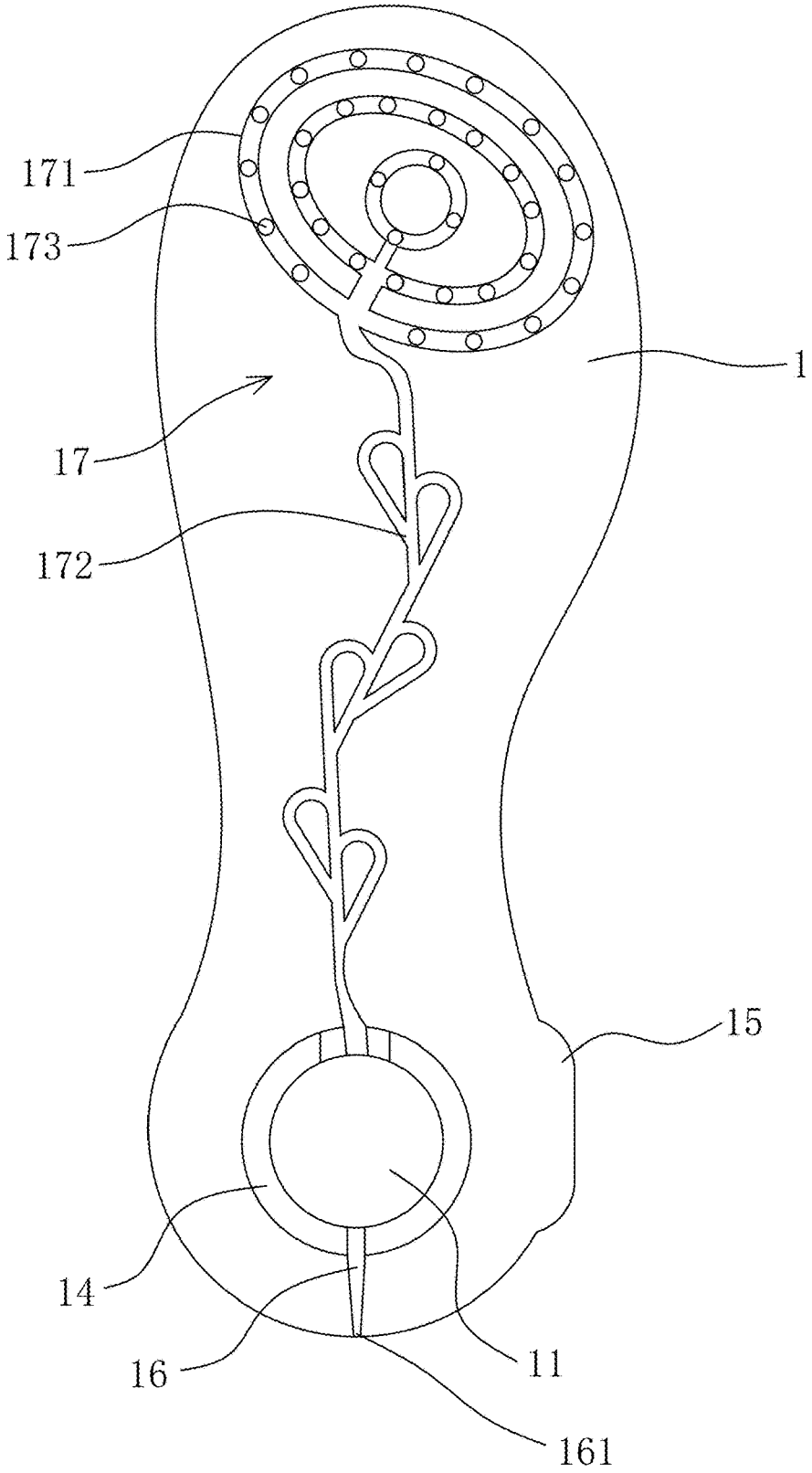
FIG. 5 is a top view of the midsole of embodiment 2 of this invention.

Embodiment 2: as shown in FIG. 5, a breathable sole, comprising a sole body, which is provided with an air chamber 11, an air outlet channel 16, and a single-way air inlet channel 17; the air chamber 11 is arranged at a heel position of the sole body, and has a structure same as that of the first embodiment, and thus will not be repeatedly described in detail. The single-way air inlet channel 17 has a Tesla Valve structure; one end of the single-way air inlet channel 17 is connected with the air chamber 11, and another end is formed with air inlet holes 173 configured to be connected to an interior of a shoe; the single-way air inlet channel 17 imposes a higher resistance against air flowing from the air chamber 11 to the air inlet holes 173 than air flowing from the air inlet holes 173 to the air chamber 11; a first end of the air outlet channel 16 is connected with the air chamber 11, and a second end of the air outlet channel is in communication with an air outlet hole 161 connecting with an external environment. When stepping downwards during walking, the air chamber 11 is compressed, and the air in the air chamber 11 is discharged to the external environment through the air outlet channel 16. Since the single-way air inlet channel 17 imposes a higher resistance against the air flowing from the air chamber 11 to the air inlet holes 173, only a small portion of air will flow through the single-way air inlet channel 17 from the air chamber to the air inlet holes 173 when the air chamber 11 is compressed; when lifting the foot as walking continues, the air chamber 11 is elastically restored; the air inside the shoe is drawn into the air chamber 11 through the single-way air inlet channel 17 and is discharged to the external environment when the foot steps downwards again during walking, so as to expel the moisture and odour inside the shoe to avoid the problem of foot odour.

The sole body comprises a midsole 1 and an outsole 2; a bottom surface of the midsole 1 subsides inwards to form the air chamber 11, the air outlet channel 16, and the single-way air inlet channel 17; an upper surface of the outsole 2 and the bottom surface of the midsole 1 are sealed and adhered such that the air outlet channel 16, the air chamber 11, and the single-way inlet channel 17 are sealed within.

The single-way air inlet channel 17 comprises a dispersed air-collecting channel 171 and a Tesla channel 172; the dispersed air-collecting channel 171 is arranged at a forefoot position of the sole body, and is provided with the air inlet holes 173 penetrating an upper surface of the midsole 1. The Tesla channel 172 connects the dispersed air-collecting channel 171 to the air chamber 11, and the Tesla channel 172 is a Tesla Valve.

A cross-sectional area of the air outlet channel 16 gradually reduces from the air chamber 11 towards the air outlet hole 161, so that air from the external environment will not easily enter the air chamber 11 through the air outlet channel 16, and the air in the air chamber 11 is more easily discharged through the air outlet channel 16. The air outlet channel 16 is connected to a rear end of the air chamber 11, and the single-way air inlet channel 17 is connected to a front end of the air chamber 11. When the user walks, the heel of the user first touches the ground, and thus the air chamber 11 is compressed; as a connected portion of the single-way air inlet channel 17 and the air chamber 11, connected with reference to the connecting structure described in embodiment 1, is arranged at the front end of the air chamber 11, the connection between the single-way air inlet channel 17 and the air chamber 11 is not affected; besides, a connected portion of the air outlet channel 16 and the air chamber 11 is relatively large which also does not affect the connection between the air outlet channel 16 and the air chamber 11 when the air chamber is compressed, so that the air can still be discharged through the air outlet channel 16; when the air chamber 11 is elastically restored, the air inside the shoe is drawn into the air chamber 11 through the single-way air inlet channel 17 and is then discharged to the external environment in the user steps downward again during walking. Thereby, the moisture and odour in the shoe are discharged to the external environment to prevent foot odour.

Figure 6:
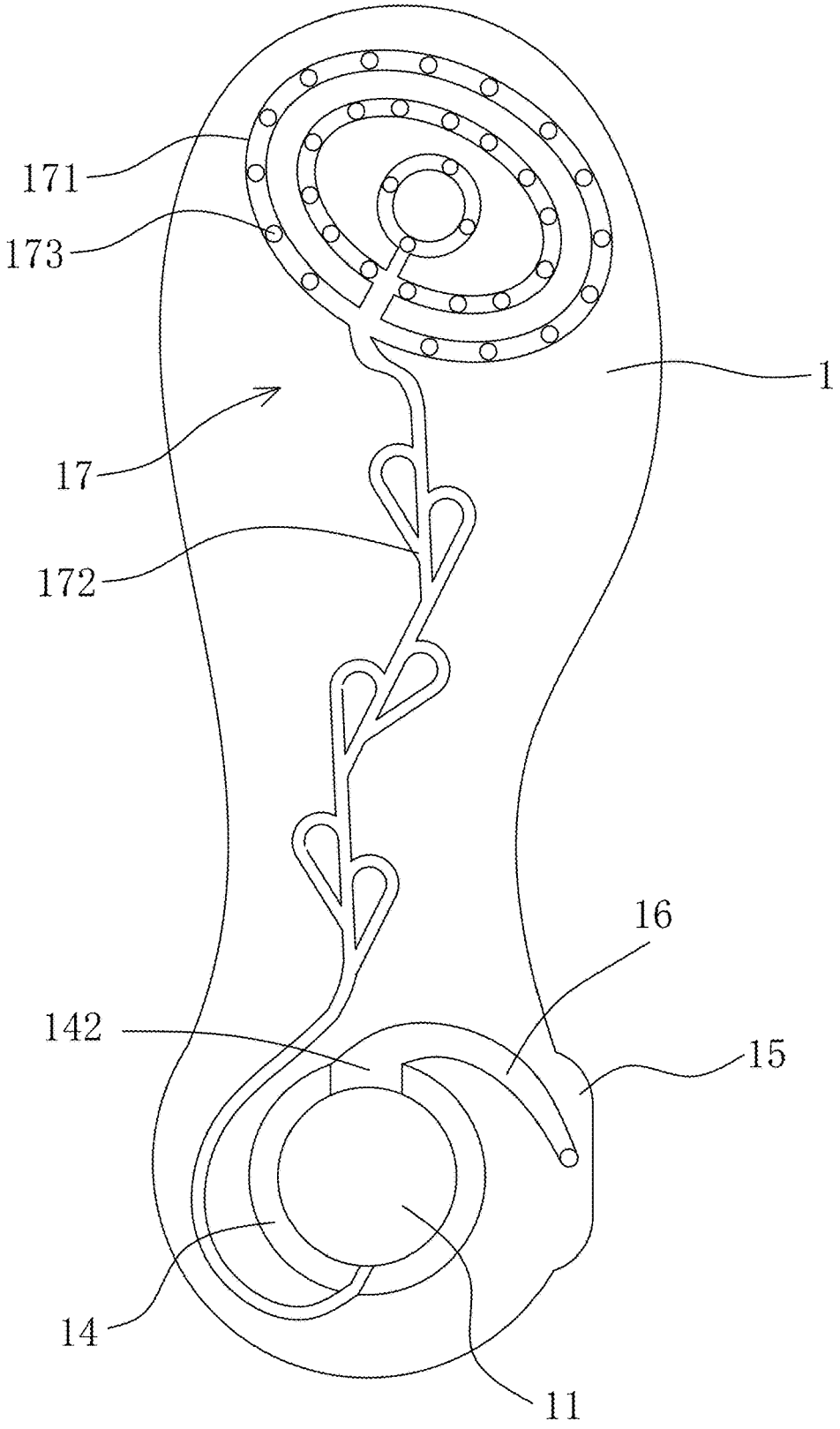
FIG. 6 is a top view of the midsole of embodiment 3 of this invention.

Embodiment 3, as shown in FIG. 6, is basically the same as Embodiment 2, except that the air outlet channel 16 is connected to the front end of the air chamber 11, and the single-way air inlet channel 17 is connected to the rear end of the air chamber 11; when the user walks, the heel of the user first touches the ground, and thus the air chamber 11 is compressed; the connected portion of the single-way air inlet channel 17 and the air chamber 11 will be compressed and sealed, so that the air in the air chamber 11 is unable to pass through the single-way air inlet channel 17 and can only be discharged through the air outlet channel 16. When the air chamber 11 is elastically restored; the air inside the shoe is drawn into the air chamber 11 through the single-way air inlet channel 17, and is then discharged to the outside of the shoe when the user steps downward again during walking. Thereby, the moisture and odor in the shoe are discharged to the external environment to prevent foot odour.

Figure 7:
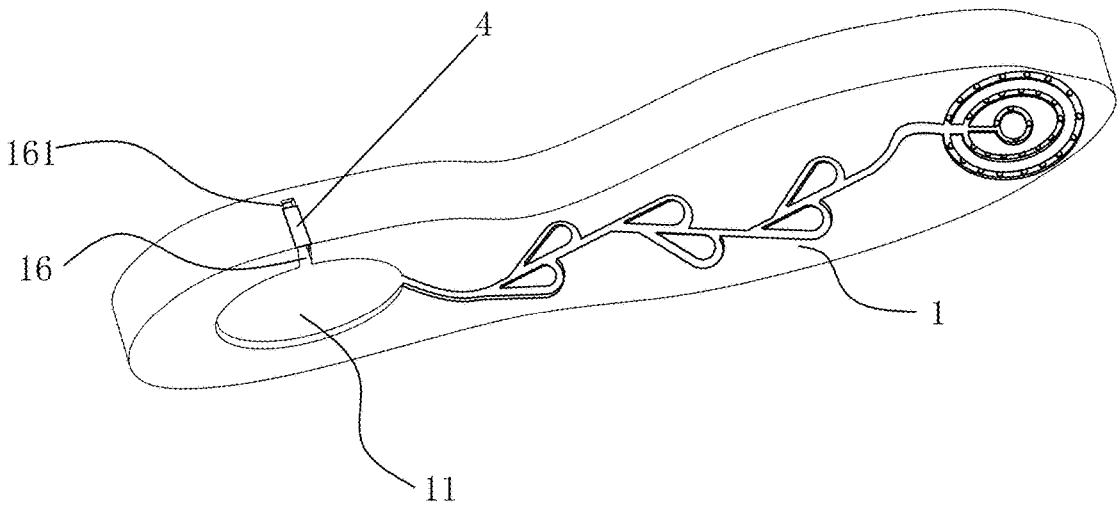
FIG. 7 is a perspective view of the midsole of embodiment 4 of this invention.
Figure 8:
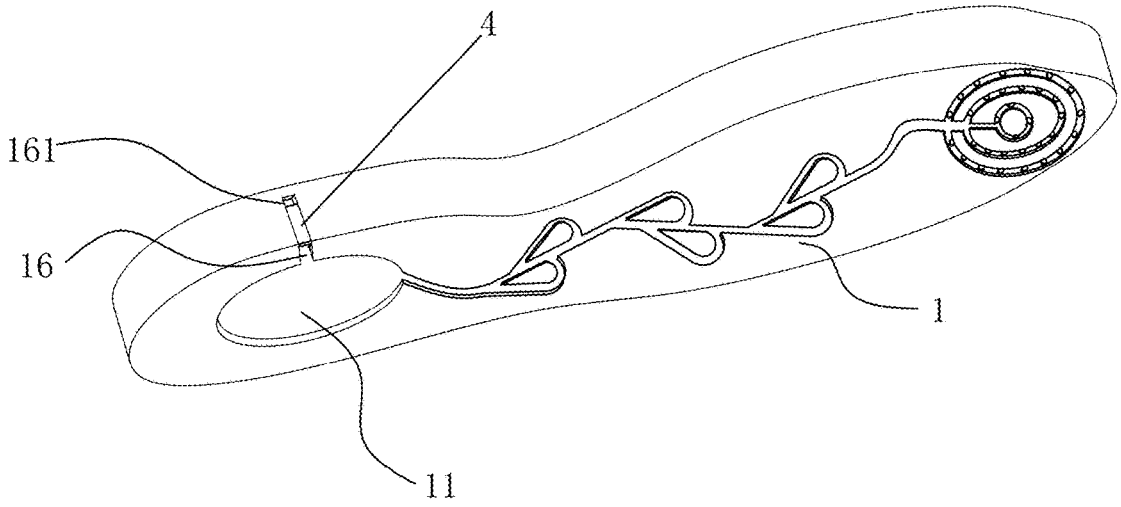
FIG. 8 is a perspective view of the midsole of embodiment 4 of this invention with an alternative configuration of the transparent piece.

Embodiment 4, as shown in FIGS. 7 and 8, is basically the same as Embodiment 2, except that the second end of the air outlet channel 16 is an elongated hole extending on an outer side wall of the midsole 1; the elongated hole is the air outlet hole 161; a transparent piece 4 is provided to partially cover the air outlet hole 161. With reference to FIG. 7, the elongated hole of the air outlet channel 16 extends on the outer side wall of the midsole 1 perpendicularly with respect to the midsole 1; the first end of the air outlet channel 16 is connected with one side of the air chamber 11; the air outlet channel 16 extends from the first end horizontally and straightly away from the air chamber 11 up till the second end on the outer side wall of the midsole 1 where the second end is formed as an elongated hole extending on the outer side wall of the midsole 1 perpendicularly with respect to the midsole 1; as said, the elongated hole is the air outlet hole 161; the transparent piece 4 is a transparent film; the transparent film is adhered to the outer side wall of the midsole 1 corresponding to the air outlet hole 161; a length of the transparent film is shorter than a length of the air outlet hole 161 extending on the outer side wall of the midsole 1; accordingly, the air outlet hole 161 is partially exposed to the external environment, either at an upper part or a lower part or both of the air outlet hole 161, so that air inside the air outlet channel 16 can be discharged to the external environment through portion(s) of the air outlet hole 161 not covered by the transparent film. During use, the transparent film allows users to observe the air being discharged from the shoe. Accordingly, users experience is enhanced.

As shown in FIG. 8, the transparent piece 4 can also be a rectangular block instead of a film. The transparent piece 4 is inserted into the air outlet channel 16 through the air outlet hole 161. A width of the transparent piece 4 is the same as a width of the air outlet hole 161. A length of the transparent piece 4 is shorter than a length of the air outlet hole 161 extending on the outer side wall of the midsole 1. A thickness of the transparent piece 4 is smaller than a length of the air outlet channel 16. As such, the air outlet hole 161 can also be partially exposed to the external environment.

Figure 9:
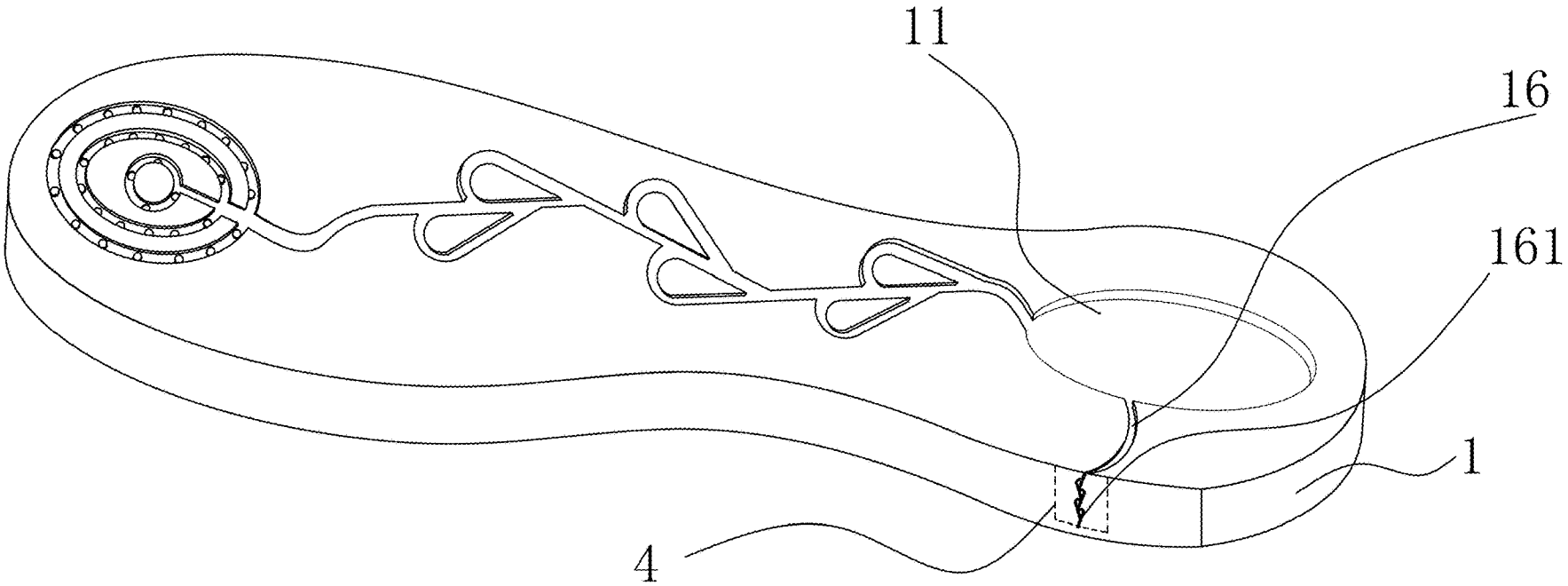
FIG. 9 is a perspective view of the midsole of embodiment 5 of this invention.

Embodiment 5, as shown in FIG. 9, is basically the same as embodiment 4, except that instead of having the second end of the air outlet channel extending as an elongated hole, a groove having a Tesla valve shape is provided on the outer side wall of the midsole 1 extending perpendicularly with respect to the midsole 1; the groove is said air outlet hole 161; the second end of the air outlet channel 16 is connected with an upper end of the groove; the transparent piece 4, embodied as a transparent film, is provided on the outer side wall of the midsole 1 to partially cover the groove. A lower end of the groove is not covered by the transparent piece 4 and is thus exposed to the external environment. Said groove having a Tesla valve shape can effectively prevent air refluxing back into the midsole 1 through the air outlet hole 161.

Figure 10:
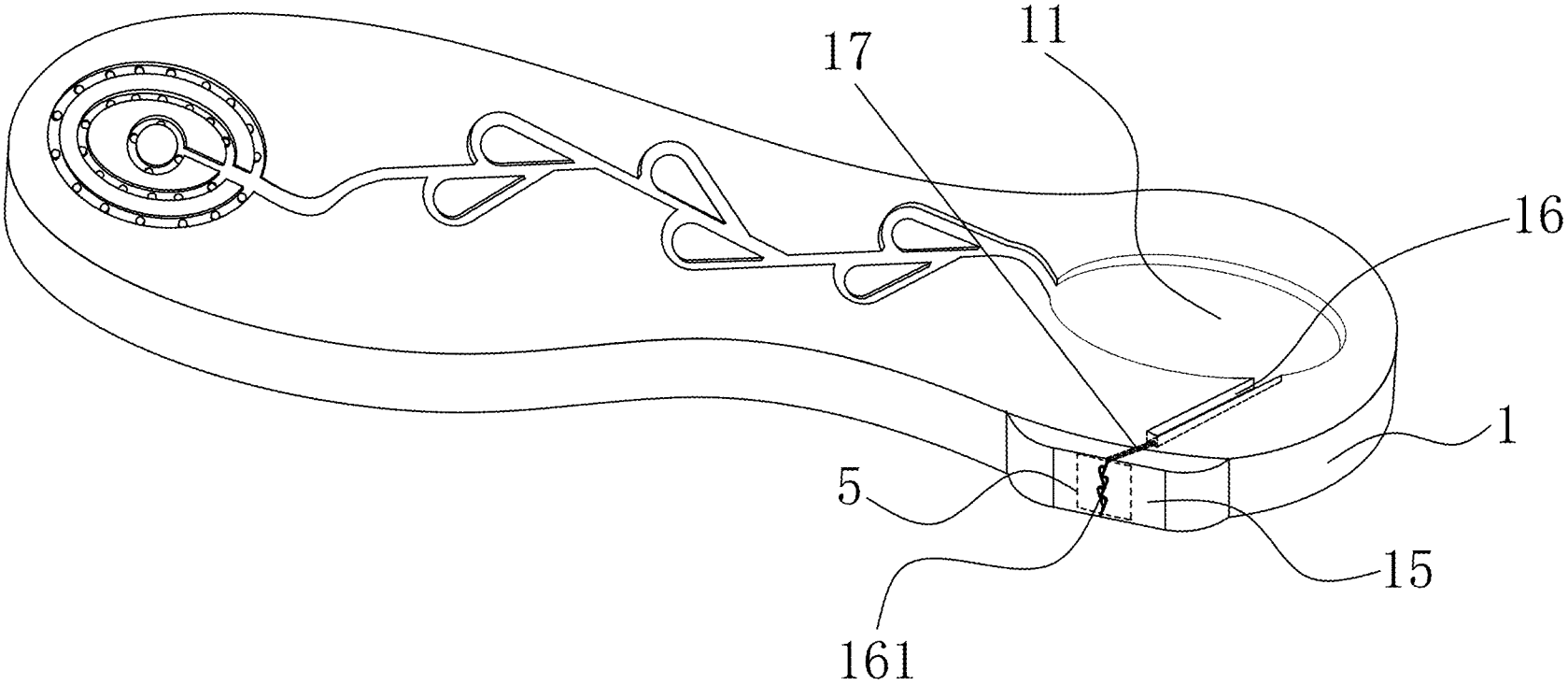
FIG. 10 is a perspective view of the midsole of embodiment 6 of this invention.

Embodiment 6, as shown in FIG. 10, is basically the same as embodiment 2, except that the first end of the air outlet channel 16 is connected to one side of the air chamber 11; the air outlet channel 16 extends towards the first outer expanding portion 15; the second end of the air outlet channel 16 is located proximal to the first outer expanding portion 15 but not within the first outer expanding portion 15; a middle part of an outer side wall of the first outer expanding portion 15 is recessed to form a groove having a Tesla valve shape extending perpendicularly with respect to the first outer expanding portion 15; an upper end and a lower end of the groove is spaced away from an upper edge and a lower edge of the first outer expanding portion 15 respectively; said groove is the air outlet hole 161; an inner communication channel 17 is provided inside the midsole 1; one end of the inner communication channel 17 is connected to an upper end of the groove inside the midsole 1, and another end of the inner communication channel 17 is connected with the second end of the air outlet channel 16 to communicate with the air outlet channel 16; the outer side wall of the first outer expanding portion 15 is also provided with a transparent member 5 corresponding to the air outlet hole 161 to partially cover the air outlet hole 161; the transparent member 5 is a film; a lower end of the groove is not covered by the transparent member 5. During use, the transparent member 5 allows users to observe the air being discharged from the shoe. Accordingly, users experience is enhanced. Further, the groove in a Tesla valve shape can effectively prevent air from refluxing back into the midsole 1 through the air outlet hole 161.

Figure 11:
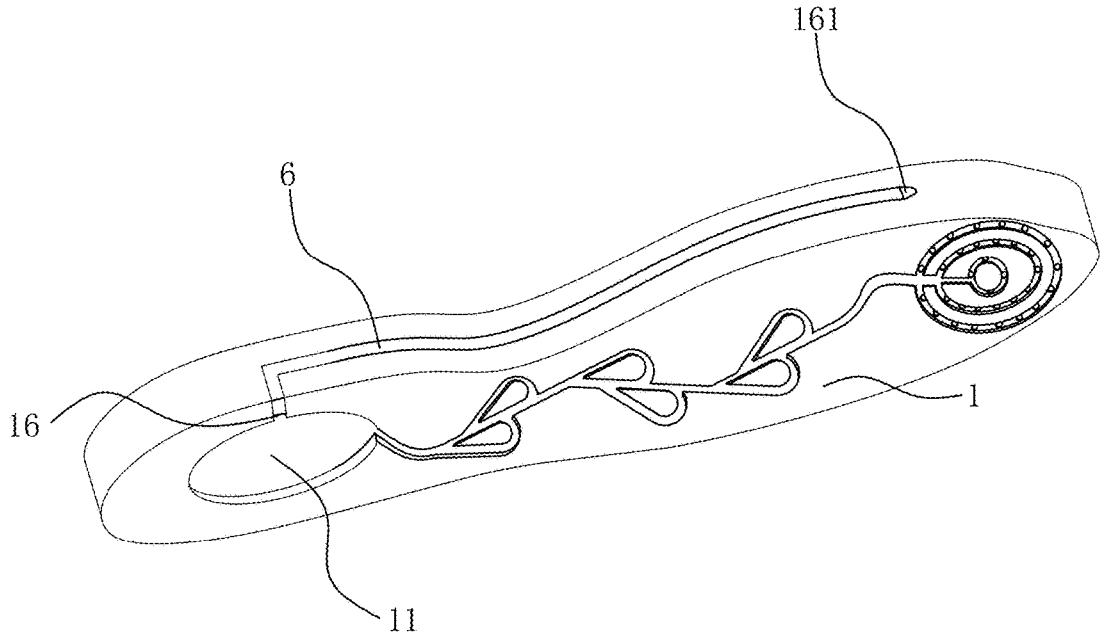
FIG. 11 is a perspective view of the midsole of embodiment 7 of this invention.
Figure 12:
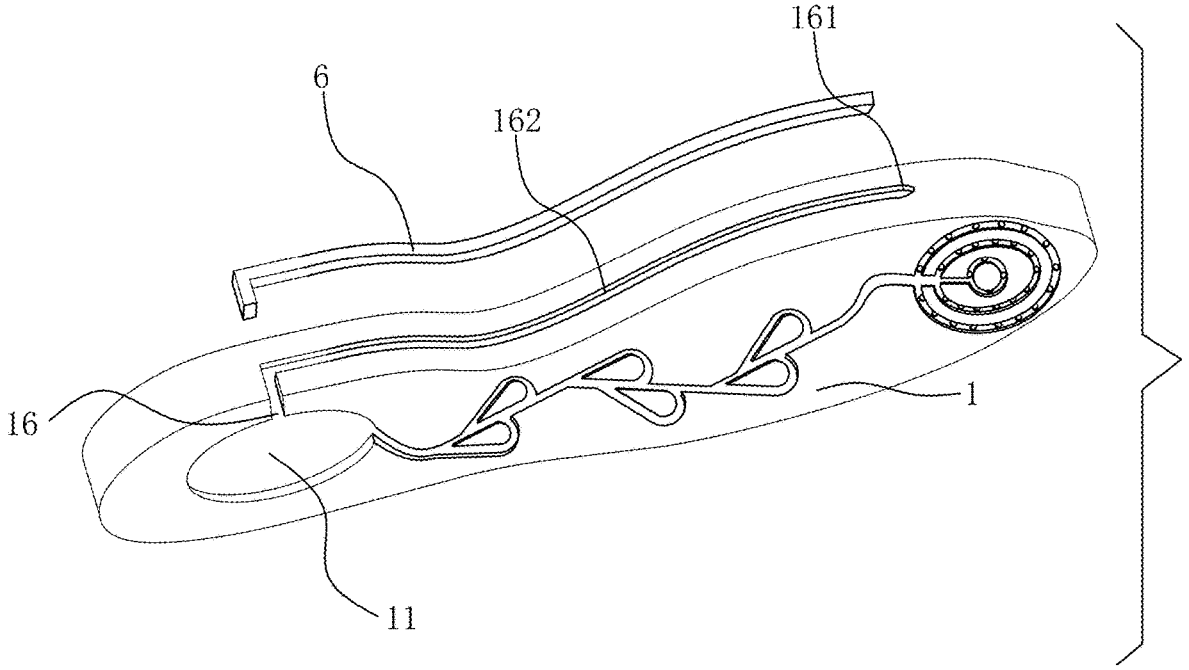
FIG. 12 is an exploded view of FIG. 11.

Embodiment 7, as shown in FIGS. 11-12, is basically the same as embodiment 2, except that the first end of the air outlet channel 16 is connected with one side of the air chamber 11; the air outlet channel 16 extends to an outer side wall of the midsole 1 so that the second end of the air outlet channel 16 is located on the outer side wall of the midsole 1; the air outlet channel 16 has a depth extending from the bottom surface of the midsole 1 towards the upper surface of the midsole 1; the outer side wall of the midsole 1 is also recessed to form an extended channel 162; one end of the extended channel 162 is connected to the second end of the air outlet channel 16; another end of the extended channel 162 is located on the outer side wall of the midsole 1 corresponding to the forefoot position of the midsole 1; a transparent strip 6 is provided on the outer side wall of the midsole 1 corresponding to the extended channel 162 to cover the extended channel 162; a hole is provided on the outer side wall of the midsole 1 in front of said another end of the extended channel 162; the hole is in communication with the extended channel 162 and is not covered by the transparent strip 6; the hole is the air outlet hole 161. In other words, the transparent strip 6 is disposed on the outer side wall of the midsole 1 to cover the entire extended channel 162, while the air outlet hole 161 is not covered by the transparent strip 6. As such, the air outlet hole 161 in communication with the extended channel 162 is located at the forefoot position of the midsole 1, and so air from the shoe is discharged from the shoe at the forefoot position of the midsole 1, which facilitates the users to observe more directly the air being discharged from the midsole 1.

Figure 13:
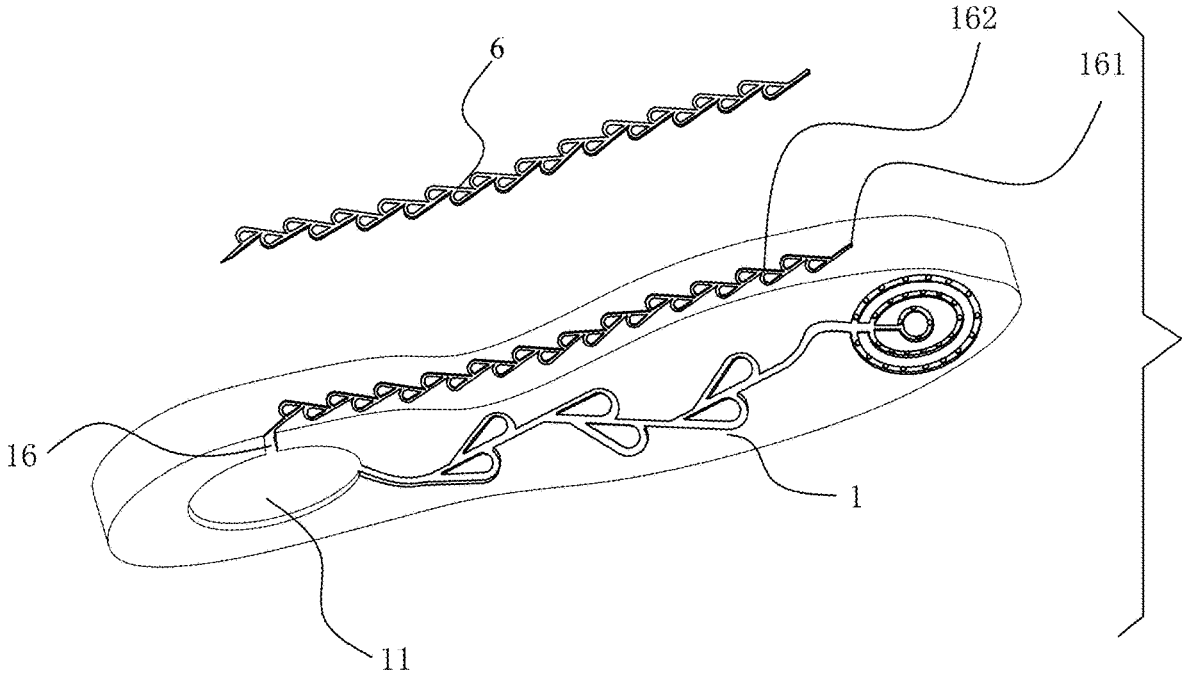
FIG. 13 is a perspective view of the midsole of embodiment 8 of this invention.

Embodiment 8, as shown in FIG. 13, is basically the same as embodiment 7, except that the extended channel 162 has a Tesla valve shape. The extended channel 162 in a Tesla valve shape can prevent air from refluxing back into the midsole 1 through the air outlet hole 161. Further, since the extended channel 162 is extended to the forefoot position of the midsole 1, the shape of the Tesla valve is more extended and the effect of preventing air from refluxing back into the midsole 1 through the air outlet hole 161 can be more prominent. Alternatively, the transparent strip 6 may also be a conventional transparent film.

What is claimed is:

1. A breathable sole, comprising a sole body, which is provided with an air chamber, an air outlet channel, and a single-way air inlet channel; the air chamber is arranged at a heel position of the sole body; the single-way air inlet channel has a Tesla valve structure; one end of the single-way air inlet channel is connected with the air chamber, and another end of the single-way air inlet channel is formed with air inlet holes configured to be connected to an interior of a shoe; the single-way air inlet channel imposes a higher resistance against air flowing from the air chamber to the air inlet holes than air flowing from the air inlet holes to the air chamber; a first end of the air outlet channel is connected with the air chamber, and a second end of the air outlet channel is in communication with an air outlet hole connecting with an external environment; the sole body comprises a midsole and an outsole; a bottom surface of the midsole subsides inwards to form the air chamber, the air outlet channel, and the single-way air inlet channel; an upper surface of the outsole and the bottom surface of the midsole are sealed and adhered such that the air outlet channel, the air chamber, and the single-way inlet channel are sealed between the outsole and the midsole; the air outlet channel extends to an outer side wall of the midsole so that the second end of the air outlet channel is located on the outer side wall of the midsole; the outer side wall of the midsole is also recessed to form an extended channel; one end of the extended channel is connected to the second end of the air outlet channel; another end of the extended channel is located on the outer side wall of the midsole corresponding to a forefoot position of the midsole; a transparent strip is provided on the outer side wall of the midsole corresponding to the extended channel to cover the extended channel; a hole is provided on the outer side wall of the midsole in front of said another end of the extended channel; the hole is in communication with the extended channel and is not covered by the transparent strip; the hole is the air outlet hole.

2. The breathable sole of claim 1, wherein the extended channel has a Tesla valve shape.

* * * * *